US005502285A

United States Patent [19]

Flohr

[11] Patent Number: 5,502,285

[45] Date of Patent: Mar. 26, 1996

[54] CONTACT-SEPARATING DEVICE FOR CIRCUIT BREAKERS

[75] Inventor: Peter Flohr, Main, Germany

[73] Assignee: Heinrich Kopp AG, Kahl/Main, Germany

[21] Appl. No.: 280,100

[22] Filed: Jul. 25, 1994

[30] Foreign Application Priority Data

Aug. 3, 1993 [DE] Germany ..... 43 26 067.5

[51] Int. Cl.[6] ..... H01H 5/00

[52] U.S. Cl. ..... 200/400; 200/DIG. 42; 200/244; 200/250; 74/516; 74/522

[58] Field of Search ..... 200/400, 244, 200/249, 250, 251, 256, DIG. 42; 74/516, 522

[56] References Cited

U.S. PATENT DOCUMENTS 3,953,697 4/1976 Teichert ..... 200/DIG. 42
4,061,895 12/1977 Hults ..... 200/DIG. 42

FOREIGN PATENT DOCUMENTS 1049956 2/1959 Germany .
1140630 12/1962 Germany .
1640996 12/1970 Germany .
9302253U1 6/1993 Germany .

OTHER PUBLICATIONS

DE Search Report Feb. 2, 1994.

*Primary Examiner*—Henry J. Recla
*Assistant Examiner*—David J. Walczak
*Attorney, Agent, or Firm*—Skjerven, Morrill, MacPherson, Franklin & Friel; Thomas S. MacDonald

[57] ABSTRACT

A device for separating a pair of electric contacts which tend to weld and consist of a stationary contact 11 and a contact 12 which is movable away from the stationary contact, particularly in a circuit breaker is provided. The device includes a tripping lever 17, which is biased in a contact-separating direction and serves to actuate the movable contact 12, and means 19 for holding the tripping lever 17 in its stand-by position. The movement of the tripping lever 17 from its stand-by position involves a displacement of a lever fulcrum to a first position where a strong separating force is exerted on the movable contact 12 and then to a second position where a weaker separating force is exerted on the movable contact 12.

10 Claims, 2 Drawing Sheets

CONTACT-SEPARATING DEVICE FOR CIRCUIT BREAKERS

BACKGROUND OF THE INVENTION

1. Field of the Invention

This invention relates to a device for separating a pair of electric contacts which tend to weld and consist of a stationary contact and a contact which is movable away from said stationary contact, particularly in a circuit breaker.

2. Description of the Prior Art

Pairs of contacts in switchgear are desirably made from a homogeneous noble material, preferably silver, in order to achieve good arcing properties and a low voltage drop across the contacts. But during a flow of short-circuit currents having a certain magnitude said material undesirably tends to effect a welding between the contacts. For this reason it is known to make the pairs of contacts from heterogeneous materials, such as sintered contacts, which will not tend to weld if they contain, e.g., carbon.

Such a risk of a welding of contacts will arise during a flow of a current below 400 amperes. During a flow of such a current in conventional switchgear a striking armature cannot yet be effective and the existing kinematic arrangement cannot separate the sticking contacts.

But the use of heterogeneous materials in such pairs of contacts has the disadvantage that they have poorer arcing properties. Besides, their use gives rise to considerable problems during the manufacture, particularly because a contact which has only a low tendency to weld can be mounted only with difficulty on a contact carrier.

SUMMARY OF THE INVENTION

It is an object of the invention to provide a device which is of the kind described first hereinbefore and which permits a pair of contacts to be made from homogeneous noble materials although they involve a risk of contact welding.

That object is accomplished in accordance with the invention by the features characterized in claim 1. Preferred features by which the invention is improved further are apparent from the dependent claims 2 to 10.

The device provided in accordance with the invention for separating a pair of electric contacts which tend to weld and consist of a stationary contact and a contact which is movable away from the stationary contact, particularly in a circuit breaker, advantageously comprises a tripping lever, which is biased in the contact-separating direction and is movable from a stand-by position and serves to actuate the movable contact, and means for holding the tripping lever in its stand-by position, and the movement of the tripping lever from its standby position involves a displacement of its fulcrum from a position in which increased separating force is exerted on the movable contact.

The displacement of the fulcrum during the movement of the tripping lever preferably permits an initially strong separating force and a succeeding lower force for continuing the separation to be exerted on the movable contact. That displacement of the fulcrum can be effected by various kinematic arrangements, which may comprise, inter alia, suitable cams. The tripping lever preferably comprises a first leg, which is engageable by the holding means, and a second leg for engaging the movable contact, and if the tripping lever is rotatably and displaceably mounted between its two legs and is mounted at its second leg to be pivotally movable at an abutment, a kinematic arrangement will be obtained which is extremely compact and conveniently operable and can be manufactured by simple technology. In that kinematic arrangement the desired relationship of the contact-separating force and the extent of the contact-opening movement can be achieved.

The turning and sliding joint preferably permits a displacement in such a direction that the tripping lever in a first part of its movement from its stand-by position is pivotally movable about its abutting fulcrum at a higher lever ratio and in a second part of its movement is displaceable in the turning and sliding joint either in addition to its rotary movement or in the absence of a simultaneous rotary movement, and in a third part of its movement is pivotally movable about the turning and sliding joint at a relatively lower lever ratio.

It is apparent that the invention desirably provides a tripping lever, which in its make or stand-by position is biased between a fixed abutment point, e.g., in a circuit breaker housing, and holding means, which preferably comprise a detent, in the contact-separating direction by a tripping spring. After the tripping lever has been released, it will first pivot in the contact-separating direction under the action of the tripping spring about its abutting fulcrum, particularly at a stop in the housing. Owing to the lever ratio of the tripping lever the force of the tripping spring is so increased that the separating force exerted on the movable contact is much stronger than it would be if the rotation had been effected from the beginning about the stationary pivot pin, e.g., in the housing.

After the contact has been separated by a strong force, the tripping lever under the action exerted on it by the tripping spring continues to rotate until the slot in the tripping lever strikes against the stationary pivot pin of the housing. At that time the fulcrum is so displaced that the lever ratio is changed in a sense to decrease the force exerted on the movable contact. That effect is assisted by the fact that the pivotal movement of the lever has the result that the changing conditions of action decrease the resulting force exerted on the movable contact. Owing to the gearing up, the movable contact is then moved to the required final OFF position and a strong force is not required during that third part of the movement.

According to a further preferred feature of the invention the position of the abutting fulcrum and the position of the turning and sliding joint for the tripping lever are so selected that the line of action of the force exerted on the movable contact and the direction of the movement of the contact as it is opened coincide and the subsequent pivotal movement then causes said directions to diverge to reduce the force which is exerted.

As has briefly been suggested hereinbefore, the turning and sliding joint preferably comprises a pivot pin, which is stationary or fixed to the housing and is guided in a slot. The tripping spring for biasing the tripping lever is preferably pivoted to the first leg and the line of action of the tripping spring is so selected that the length of the resulting lever arm will be smaller during the pivotal movement of the tripping lever in the third part of its movement than the length of the resulting lever arm during the first part of the movement.

The holding means referred to hereinbefore may be constituted in a particularly simple manner by a releasable detent mechanism, which for use in switchgear comprises a detent lever.

Because the invention permits an effective and reliable separation of contacts which may stick together, a use of heterogeneous contact, such as sintered contacts, is desirably avoided. The design in accordance with the invention desirably avoids a need for additional structural and manufacturing expenditures and permits the contact material to be selected only from electrical and economical aspects.

DETAILED DESCRIPTION OF THE PREFERRED EMBODIMENT

The invention will now be described in more detail with reference to the accompanying drawings.

Figure 1:
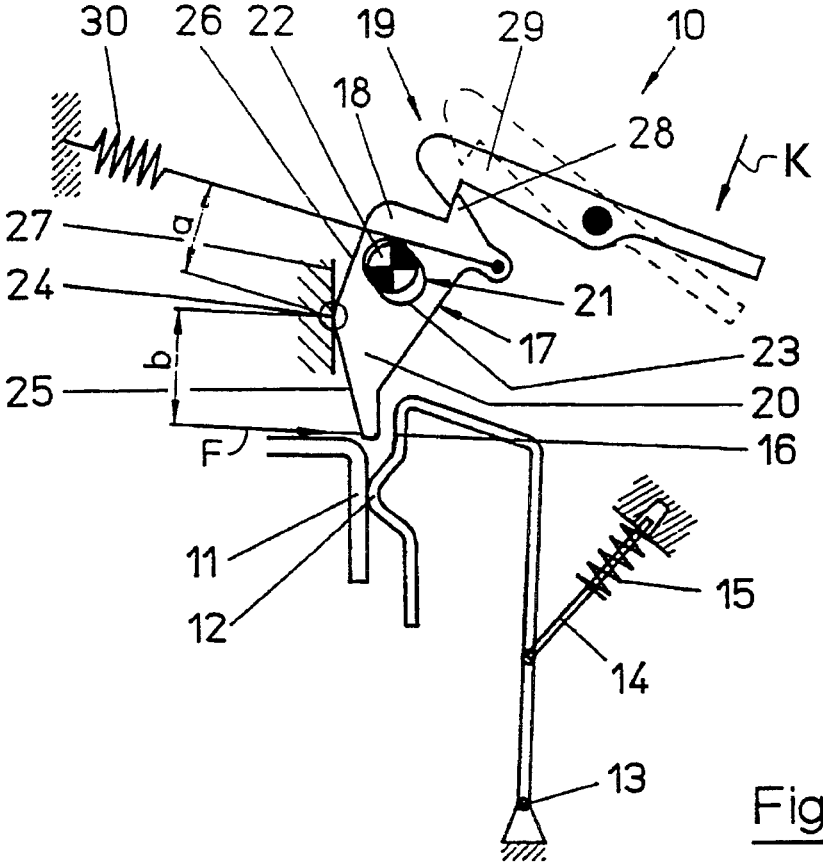
FIG. 1 is a schematic sketch showing an illustrative embodiment of a device in accordance with the invention in its stand-by position.
Figure 2:
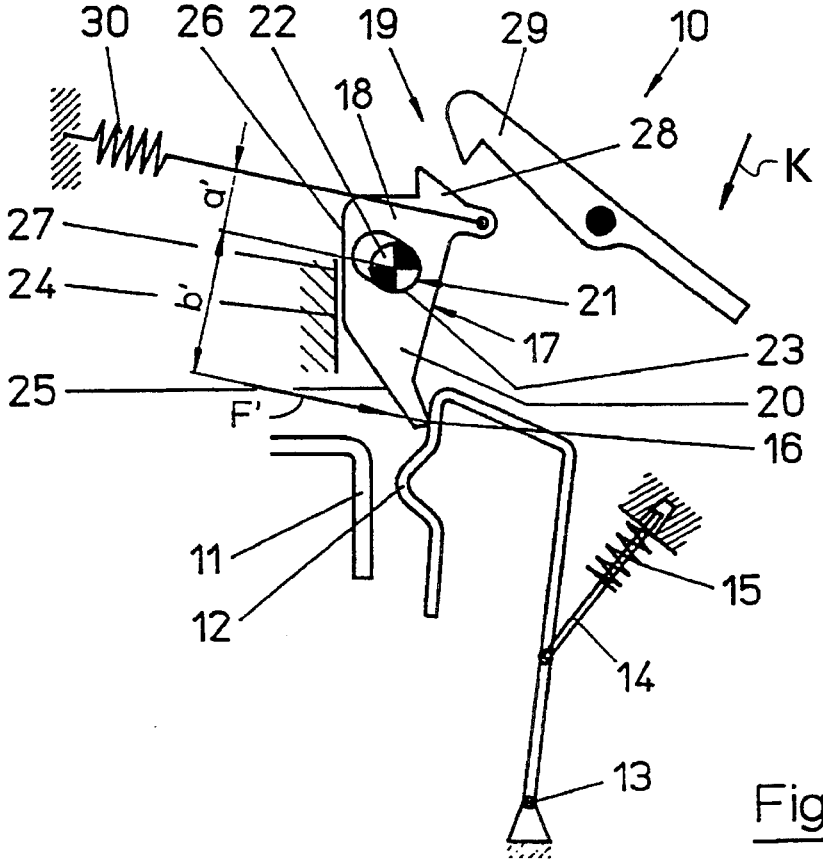
FIG. 2 is a view that is similar to FIG. 1 and shows the movable contact in its final OFF position.

FIGS. 1 and 2 show a device 10 for separating a pair of electric contacts which tend to weld and consist of a stationary contact 11 and a contact 12, which is movable away from the stationary contact. That device is intended for use in a circuit breaker. The movable contact 12 is arcuate and at its opposite end is pivoted to the housing at 13. The contact-closing force is exerted via a member 14, which is pivoted to the contact 12 and at its other end is supported against the housing by a pressure-applying spring 15. Suitable coatings on the contacts have not been shown for the sake of simplicity.

The arcuate movable contact 12 comprises a vertically rising actuating portion 16, which is engageable by a tripping lever 17.

The tripping lever 17 comprises a first leg 18, which is engageable by holding means 19, and a second leg 20 for engaging the movable contact 12 at its actuating portion 16. Between its two legs 18 and 20 the tripping lever 17 is mounted in a turning and sliding joint 21 so that the tripping lever 17 can be turned and displaced. The turning and sliding joint 21 comprises a stationary pivot pin 22, which is guided in a slot 23.

The second leg 20 is provided at its outer edge at a distance from the turning and sliding joint with a bearing fulcrum 24 at the intersection of two engaging surfaces 25 and 26, which extend at an angle to each other. The tripping lever 17 is pivotally moved about its bearing fulcrum 24 during an initial first part of its movement. The bearing fulcrum 24 bears on a flat surface 27 of the housing; that surface also constitutes a stop for the engaging surface 26 when it has been pivotally moved, see FIG. 2.

The first leg 18 of the tripping lever 17 is formed with a detent 28, which together with a detent lever 29 constitutes holding means 19 consisting of a detent mechanism. The detent lever 29 is also pivoted to the housing and from its locked position shown in the drawing (FIG. 1) can be pivoted to the position illustrated by broken lines when a force K is exerted on the other end of the detent lever.

A tripping spring 30 is pivoted to the first leg 18 at a distance from the turning and sliding joint 21 and at its other end is secured to the housing.

FIG. 1 illustrates the lever ratio of the tripping lever 17 when it is in its stand-by position and is acted upon by the tripping spring 30 and supported at its bearing fulcrum 24 on the flat housing wall 27. Said lever ratio will determine the separating force F which is exerted by the tripping lever 17 on the movable contact 12. A comparison with FIG. 2, in which the tripping lever 17 has reached its final OFF position, will reveal that the leverage or lever ratio has changed to a':b' so that the conditions are different from those determined by the lever ratio a:b. This is due to the fact that the fulcrum has been displaced during the movement of the tripping lever 17 that included the pivotal movement under a strong force about the bearing fulcrum 24 and a succeeding relative displacement of the pivot pin 22 in the slot 23. At the lever ratio a':b' the pivotal movement is effected under such conditions that a relatively weaker force F' is exerted.

Figure 3:
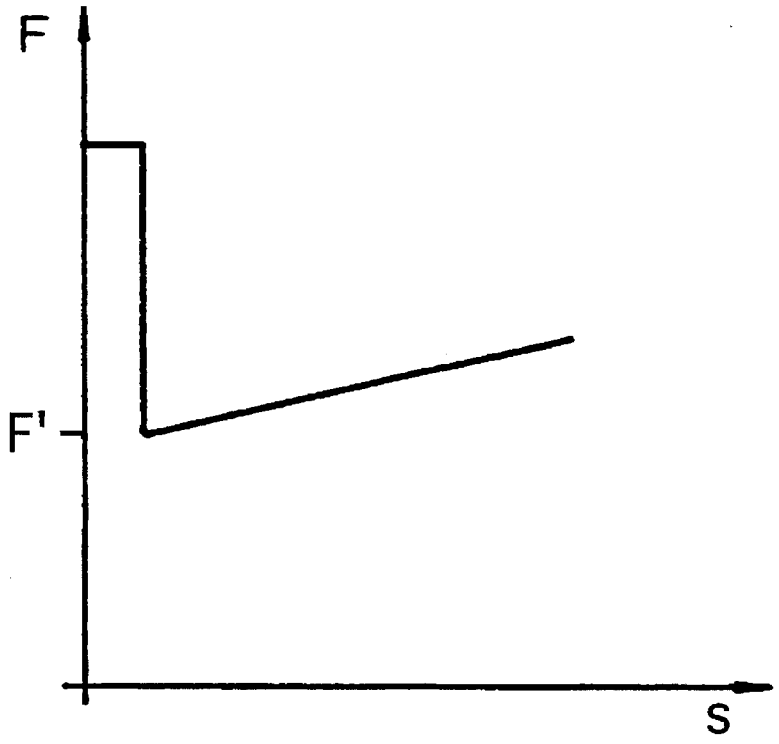
FIG. 3 is a graph illustrating the dependence of the separating force on the extent of the contact-opening movement.

FIG. 3 clearly shows the change of the separating force F in dependence on the extent of the contact-opening movement S. During the first part of the movement, when a strong separating force F is required, an extremely strong force can be exerted by the device. During an extremely short second part of the movement the displacement of the tripping lever 17 in the turning and sliding joint 21 causes that force to be decreased in steps to a much lower value F', which subsequently increases slightly owing to the conditions for the engagement between the second leg 20 and the actuating portion 16.

I claim:

1. A device for separating a pair of electric contacts in a circuit breaker which tend to weld and consist of a stationary contact and a movable contact which is movable away from the stationary contact:

comprising a tripping lever for actuating said movable contact, said tripping lever being biased in a contact-separating direction and movable about a tripping lever fulcrum from a stand-by position to a displaced position and means for holding the tripping lever in the stand-by position and for tripping the tripping lever from the stand-by position, the movement of the tripping lever from its stand-by position after a tripping involving a displacement of the fulcrum for exerting a biased separating force on said movable contact.

2. A device according to claim 1, wherein the movement of the tripping lever involves a displacement of the fulcrum such that a strong initial separating force is initially exerted on the movable contact, succeeded by the exertion of a lower separation-continuing force on the movable contact.

3. A device according to claim 2, wherein the tripping lever comprises a first leg which is engageable by said holding means, and a second leg including the fulcrum for engaging the movable contact, the tripping lever being movably mounted by a turning and sliding joint between the lever two legs and pivotable at the fulcrum of the second leg.

4. A device according to claim 3, wherein the turning and sliding joint permits displacement of the tripping lever so that in a first part of lever movement from the movement from the stand-by position the lever is pivotally movable about the fulcrum at a high leverage and in a succeeding second part of lever movement is additionally displaceable in the turning and sliding joint and in a third part of lever movement the lever is pivotally movable about the turning and sliding joint at a relatively low leverage.

5. A device according to claim 4, wherein the position of the fulcrum and the position of the turning and sliding joint are determined so that a direction of the separating force exerted on the movable contact and the direction of movement of said movable contact as the contacts are opened coincide and the subsequent pivotal movement of the tripping lever causes said directions to diverge to reduce the exerted actuating force.

6. A device according to claim 3, wherein the turning and sliding joint comprises a stationary pivot pin which is guided in a slot.

7. A device according to claim 3, wherein the tripping lever comprises engaging surfaces which are disposed on both sides of the fulcrum and extend at an angle to each other.

8. A device according to claim 1, wherein the tripping lever is biased by a force of the tripping spring which engages the first leg.

9. A device according to claim 8, wherein a direction of the force of the tripping spring is determined so that the length of a lever arm of said tripping lever is smaller during the pivotal movement of the tripping lever during a later part of lever movement than during a first part of lever movement.

10. A device according to claim 1, wherein the holding means comprise a releasable detent mechanism.

* * * * *